United States Patent [19]

Szabo

[11] 4,063,256

[45] Dec. 13, 1977

[54] PHOTOCOMPOSITION MACHINE FONT SOURCE

[75] Inventor: Francis S. Szabo, Morristown, N.J.

[73] Assignee: Addressograph-Multigraph Corporation, Cleveland, Ohio

[21] Appl. No.: 682,186

[22] Filed: Apr. 30, 1976

[51] Int. Cl.[2] ..... B41B 17/32

[52] U.S. Cl. ..... 354/13; 354/15

[58] Field of Search ..... 354/13, 15, 16, 19, 354/14, 5, 7, 292

[56] References Cited

U.S. PATENT DOCUMENTS

| | | | |
|---|---|---|---|
| 2,989,904 | 6/1961 | Braggs et al. | 354/14 |
| 3,106,880 | 10/1963 | Rossetto et al. | 354/7 |
| 3,768,384 | 10/1973 | Mason | 354/15 |
| 3,959,800 | 5/1976 | Friedel | 354/15 X |
| 3,975,745 | 8/1976 | Peck | 354/13 X |

*Primary Examiner*—Edna M. O'Connor
*Attorney, Agent, or Firm*—Ray S. Pyle

[57] ABSTRACT

A turret mounted series of photocomposing disc fonts wherein the turret has a series of disc hubs all having a different elevation in order that the disc members may be bunched together in overlapped relationship and hence occupy a minimum area within the photocomposing machine. The advance in the art is primarily in the placement of the discs in overlap relationship and then advancing or retracting the turret in order to accomplish proper positioning of the disc as opposed to the concept of the prior art in keeping all discs on one plane and then rotating the turret to bring each disc in turn into the optical system.

8 Claims, 5 Drawing Figures

PHOTOCOMPOSITION MACHINE FONT SOURCE

BACKGROUND OF THE INVENTION

The prior art employs a turret in which the disc members are all mounted on hubs of equal height and hence the turret and the discs thereon are massive in size requirements and require a substantial space enclosure.

SUMMARY OF THE INVENTION

The main purpose of this invention is to reduce the space requirements of a multiple disc system within a photocomposition machine.

It is therefore an object of the invention to overlap the disc members carried by a turret, and then to cause the turret to advance and retract along its own axis for placement of a disc into the optical system.

It is a further object of the invention to detent the turret into position by using a stepper motor for rotating the turret and reversing the stepper motor to cause a detent catch member for each hub to abut a fixed position catch, and to hold in reverse driving power during the use of a particular disc in order that mechanical variations may be eliminated.

DESCRIPTION OF THE PREFERRED EMBODIMENT

There is no effort to show a complete photocomposition machine or system, because this invention is directed to a font source for a wide variety of photocomposition machines. Any machine which uses a rotating disc font source will be able to utilize the concepts of this invention.

Figure 1:
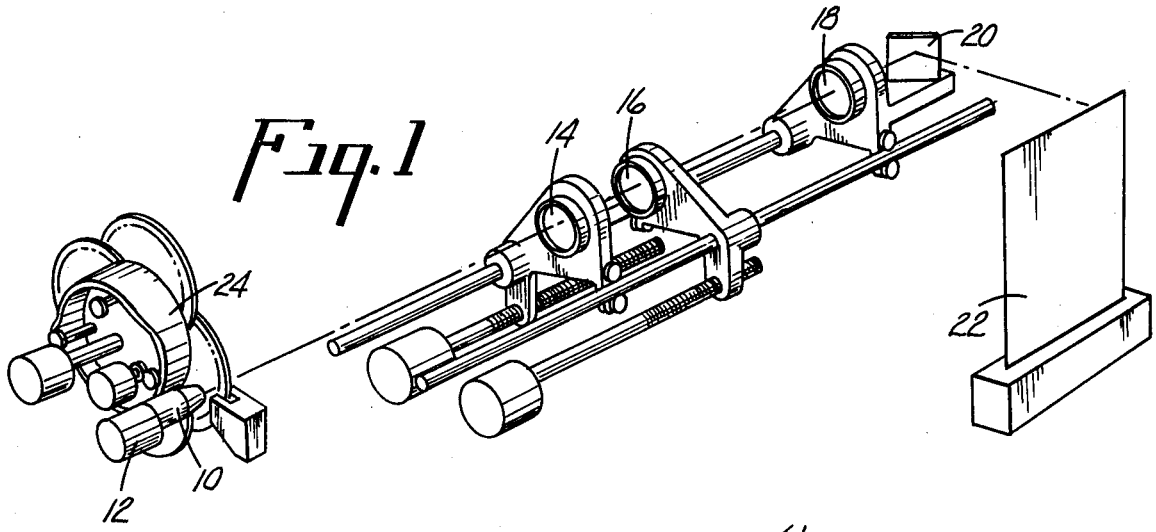
FIG. 1 is a schematic representation of a photocomposition machine and embodying the turret font arrangement of this invention.

However, the FIG. 1 is a schematic illustration of the essential concept of a photocomposition machine, and a schematic illustration of the present invention turret is included. The essence of an optical system is incorporated in the illustrated components of a xenon flash 10 which is supplied by a power pack 12, a variable focusing lens 14, a collimating lens 16, a decollimating lens 18, with a mirror 20 to bring the decollimated image into focus on the surface of a photosensitive paper sheet 22. This optical and lens system is a generally known, commercially available system, incorporated, for example, in the currently available COMP/SET TM phototypesetter manufactured and sold by Addressograph-Multigraph Corporation under its VARITYPER trademark, manufactured at Hanover, New Jersey, U.S.A.

The equipment thus far described is a photocomposition system wherein an optical system and a holder for photosensitive sheet of film or paper are supplied with a projectable font by a rotating disc font transparency.

The invention is in the improvement of a multiple disc font turret a preferred embodiment of which is illustrated generally in FIG. 1 and in significant detail throughout the balance of the drawing figures.

Photocomposition machines and systems which use a rotating disc, usually provide on the disc a plurality of concentric circular path rows of font. A track of information will generally be incorporated into the disc, preferably on the outer edge, to inform the machine control logic of the location of a particular font to be selected. Then by adjusting the lens system and the disc relative to one another, a circular track of font can be selected for projection. After positioning a particular font row the disc rotates at a high rate of speed. As a particular character reaches the focusing point of the lens system, a high intensity flash of radiant energy is projected through the transparency and the selected character thus backlighted for the optical system.

The purpose of this invention, as previously stated, is to provide more than one such disc for the optical system by mounting a plurality of disc members on a rotatable turret in a reduced space requirement concept. The disc members are then presented, when selected, into the projection position.

The prior art has provided a turret with such rotatable fonts, but all on one plane uniformly spaced from the surface of the turret, and hence the entire font system requires at least as much space as twice the diameter of the largest disc being used. Accommodation for such massive space requirements is not always available.

Figure 4:
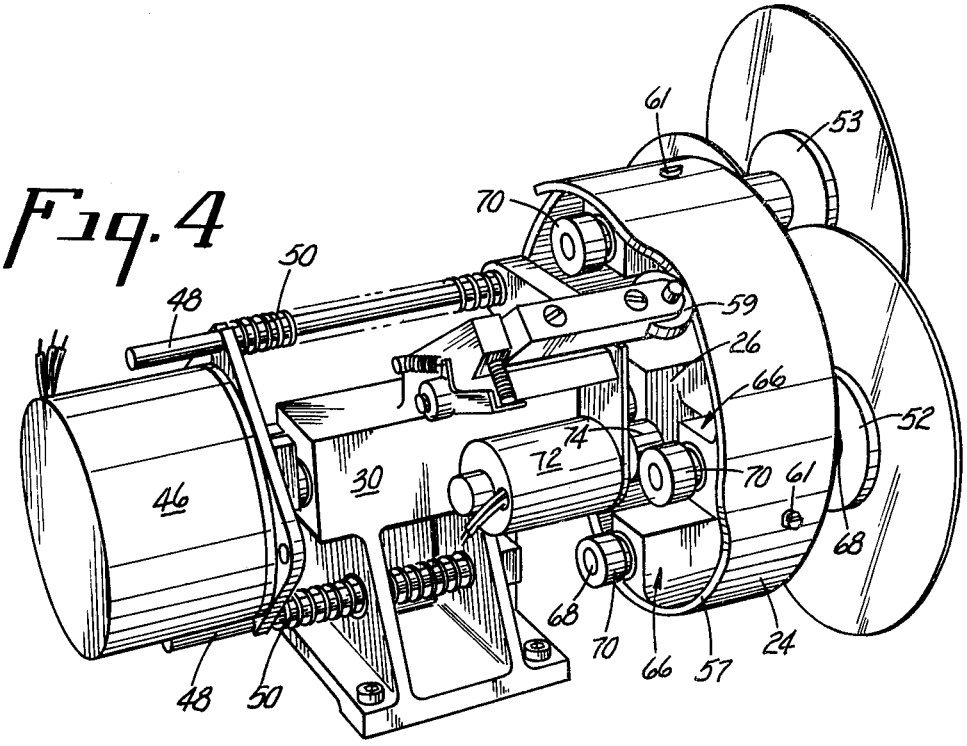
FIG. 4 is a perspective illustration on an enlarged scale of the turret and its drive mechanism separate from the auxiliary apparatus and phototypesetter.

In the drawings, the turret body is indicated by the reference character 24. Body 24 has a central pillow block 26, seen best in FIG. 4, and an axle 28 which is secured into the pillow block 26 for the purpose of driving the turret rotationally. The axle 28 constitutes the axis of the turret body.

A journal bearing block 30 forms the main support for the turret axle, and the bearing block in turn is mounted on a main base casting 32, which is complex in form, to support portions of the system for lateral shifting movement with respect to other portions which are stationary.

Figure 2:
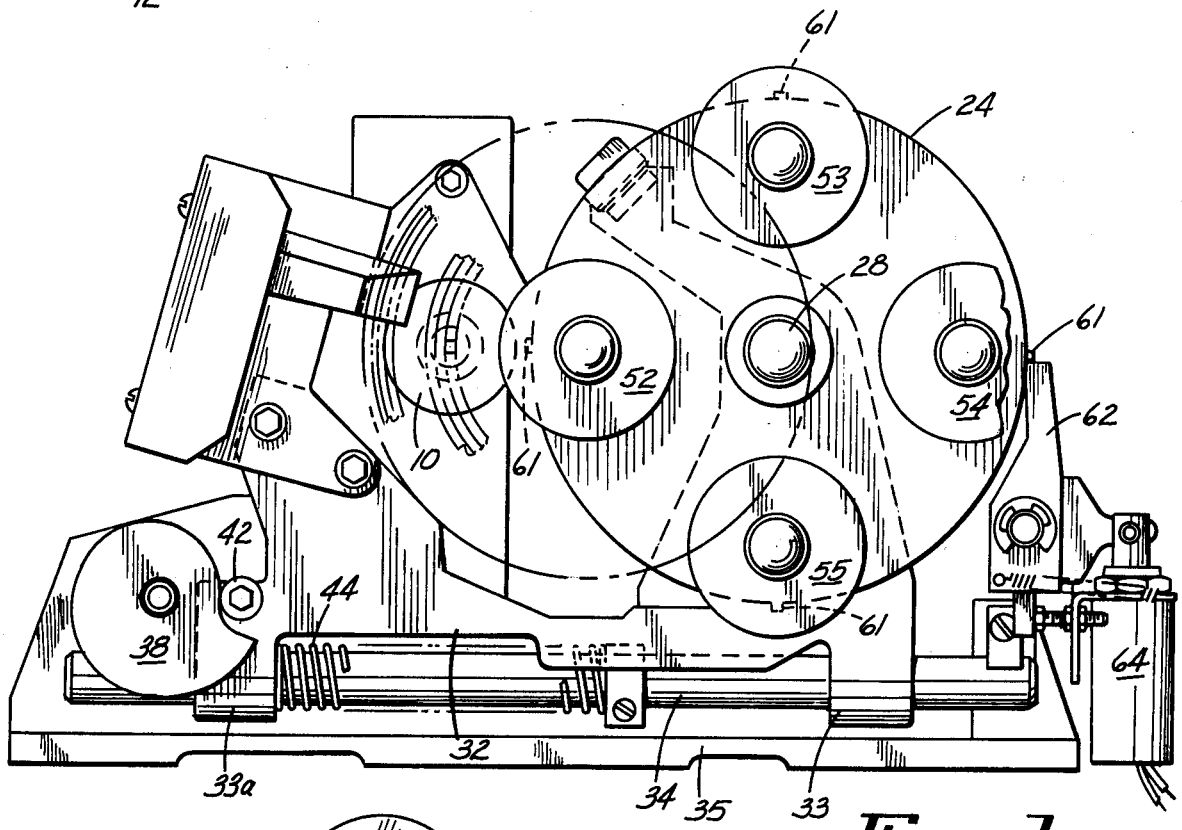
FIG. 2 is a front elevation of the turret font disc holder apparatus with one disc member only, illustrated in the exposure position.
Figure 3:
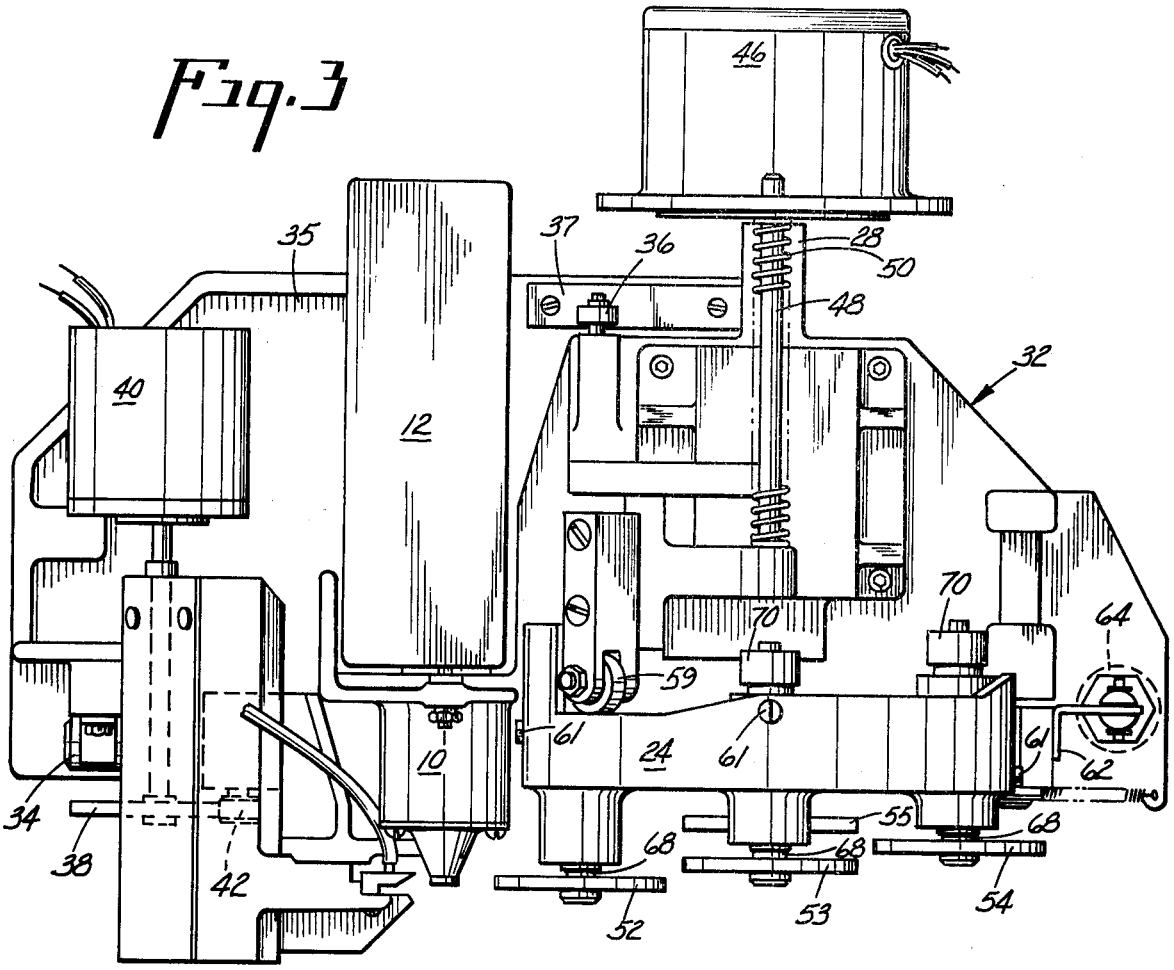
FIG. 3 is a top plan view of the apparatus shown in FIG. 2.

The main base casting 32 is supported by a lateral way rod 34 and a single support roller 36. Way 34 may be seen in FIG. 2 and roller 36 in FIG. 3. Casting 32 has two mounting ears 33 and 33*a*. Way rod 34 is supported by a lower base casting 35. Casting 35 provides a flat runway 37 for roller 36.

Lateral shifting capability is thereby provided for the journal block 30 by the shiftable base 32 which serves as a base means mounting the turret for lateral shiftable positioning with respect to the optical system, whereby concentric rows of characters on a selected disc may be selected for projection, thereby further increasing the available font selection capability of the system.

In order to shift the base casting 32 laterally for such disc positioning, a cam 38, driven by a stepper motor 40, is caused to operate against, and drive, a follower 42, carried by the base casting 32. Due to the eccentric configuration of the drive cam 38, the stepper motor may be driven a precise number of steps to drive the follower 42 a known distance from a maximum "home" position.

A spring 44 surrounding the way rod 34 acts to drive the way rod toward the home position against the urge of the cam 38, and therefore reversing of the eccentric will allow the movement of the entire base casting and turret supported thereby toward the home position. Home position is used only in the sense of an extreme position to the left in FIG. 2. This position does not necessarily coincide with a useful projection position.

A motor 46 is secured to the end of shaft 28 opposite the mounting of the turret body. Shaft 28 is rotatable in the journal block 30, and is also longitudinally shiftable therein. Hence, the motor 46 and the turret body may both shift axially in the journal of the block 30.

Guide ways 48 are rods which interconnect between motor 46 and the base of journal block 30 and are sufficiently rigid to prevent recoil rotation of the motor 46 as it drives the axle 28 and the turret body 24. However, the rods are slidably connected with the motor 46 and therefore will permit axial shifting. Springs 50 are coiled about the guide ways 48 and urge the motor 46 to a retracted position, and the urge is transmitted through the axle 28 to the turret body 24, thereby causing turret 24 to retract toward the block 30.

Figure 2A:
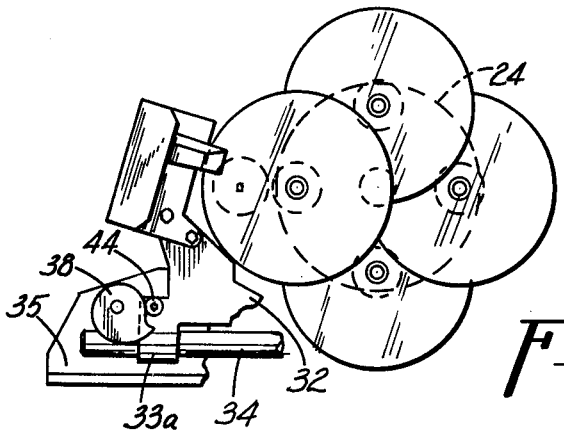
FIG. 2*a* is an abbreviated illustration of the front elevation with a full four-disc array installed.

The turret body 24 carries four hubs 52–55 uniformly spaced around the turret body but extending each to a different height from the face thereof. Hence, a series of font disc members, as illustrated in FIGS. 2*a* and in 4, will overlap with respect to one another and permit mounting the plurality of disc members in a much smaller lateral space than would be required if each of the hubs mounted the disc thereon in a common place.

The back face of the turret body is configured into a cam track 57. A follower 59 is carried by the journal block 30 and therefore is stationery with respect to longitudinal shifting, being also interconnected with the base casting 32. Hence, as rotation of the turret body takes place, the springs 50 will urge the cam track 57 against the follower 59, and the turret body will be caused to be positioned longitudinally as a function of rotational positioning. Drive is maintained to the turret body because the motor 46 is free to follow the axle 28 as the turret body shifts.

It is essential that each disc member carried by the turret be positioned precisely with respect to the lens 14 in order that a proper optical alignment be obtained. Although the motor 46 is a stepper motor and hence can be precisely programmed to rotate the turret body the proper number of rotational steps from a known starting position, nevertheless vibration and mechanical variance without adequate detenting could cause sufficient misalignment and movement during operation that a deficient image would be formed.

There are four detent catch members 61 positioned around the periphery of the turret body 24, each position functionally with respect to the desired position of a corresponding disc hub mounted on the opposite side of the turret. A latch 62 operated between a latching position as shown in FIG. 2, and a retracted unlocking position, not illustrated, will permit rotation of the turret in a counterclockwise direction as illustrated in FIG. 2, but will prevent clockwise rotation when the catch is actuated into the latching position shown in FIG. 2. Therefore, the turret is programmed to be driven beyond the desired position by selecting a greater number of steps for the stepper motor, and thereafter the stepper motor is reversed in direction to bring the appropriate detent catch 61 into contact with the latch 62. It has been found that a stepper motor may be continually energized in this reverse direction to place a drive force holding the catch 61 tightly against the latch 62 without drawing excessive current or unduly heating. Hence, this invention contemplates the precise anchoring of the rotatable turret by means of a continual pressure between catch and latch provided by reversal of the stepper motor.

Each hub 52–55 is mounted in a bearing block 66 by a shaft 68 which projects from the hub through to the back face of the turret body. An elastomeric cylinder 70 is fitted on the end of the shafts 68. A motor 72 carried on the journal block 30 is fitted with an elastomeric cylinder 74, and as the turret body is rotated, the elastomeric cylinders will engage and serve as a clutching action to transmit driving power from the motor 72 to the supported disc members. Note that each of the shafts 68 is coordinated to the cam track to place the elastomeric cylinder thereof in exact alignment with the motor elastomeric cylinder, when a particular location is selected, on the same principle employed to place a disc into optical alignment.

What is claimed is:

1. A photocomposition system wherein an optical system and a holder for photosensitive material are supplied with a projectable font by a rotating disc font transparency, the improvement in a multiple disc font holder, comprising:

a turret;

means mounting said turret for rotation about an axis in a selected space position;

motor means for driving said turret rotationally about the axis thereof;

means mounting said turret for bodily shifting along said axis;

means for shifting said turret on said mounting means as the turret is rotated;

a plurality of font disc mount hubs carried by said turret spaced apart a distance less than the diameter of the font disc mounted thereon, said hubs being each different in height from adjacent hubs to space the discs mounted thereon at different distances from the turret in overlapping relationship, and the hubs positioned to extend a portion of each mounted disc beyond the parameter of said turret;

said optical system having a fixed source of projection light located adjacent said turret and directed in a direction generally parallel to the turret axis, and a primary lens spaced therefrom;

said shifting means being configured to shift the turret a distance which will position a selected mount hub to position a disc carried thereon into the optical system;

detent means for establishing a final operating position of a mounted disc rotated and shifted into place between said light source and lens; and drive means for rotating a mounted disc positioned in said optical system.

2. Phototypesetter apparatus including a turret font disc holder for a phototypesetter comprising:

a turret having an axis of rotation;

a plurality of font disc mount hubs carried by said turret;

means mounting said turret for rotation about said axis and motor means for driving said turret rotationally about the axis;

means mounting said turret for bodily shifting along said axis;

said turret having a cam track encircling said axis, and a fixedly mounted cam follower positioned in contact with said track;

a plurality of font disc mount hubs carried by said turret spaced apart a distance less than the diameter of the font discs mounted thereon said hubs being each different in height from adjacent hubs to space the discs mounted thereon at different distances from the turret in overlapping relationship, and the hubs positioned to extend a portion of each mounted disc beyond the parameter of said turret;

an optical system having a fixed source of projection light located adjacent said turret and directed in a direction generally parallel to the turret axis, and a primary lens spaced therefrom;

said cam track configured to guide said turret in a longitudinally stable path as rotation positions one said hub to place one disc into alignment between said projection light and said lens as an active disc position with respect to said optical system, and thereafter shift said turret along said axis to place another disc into said active disc position.

3. In the turret holder of claim 2, said motor means being a stepper motor to enable disc positioning by motor step counting.

4. In the turret holder of claim 2, said motor means being a reversible stepper motor for positioning the font disc hubs by motor step count;

said turret having a detent catch member for each hub, and a fixedly mounted latch, said catch members located so that the turret may be overshot with respect to said optical system and reversed by said motor to engage the catch with the latch to establish a proper operative position, and said motor being continuously operable to urge said turret in said reverse direction although stalled by said catch and latch engagement, whereby, a firm operative position of each hub and its disc may be maintained by the urge of the stepper motor.

5. A photocomposition system wherein an optical system and a holder for photosensitive material are supplied with a projectable font by a rotating disc font transparency, the improvement in a multiple disc font holder comprising:

a turret;

means mounting said turret for rotation about an axis in a selected space position;

motor means for driving said turret rotationally about the axis thereof;

a plurality of font disc mount hubs carried by said turret and the hubs positioned to extend a portion of each disc mounted thereon beyond the parameter of said turret;

said optical system having a fixed source of projection light located adjacent said turret and directed in a direction generally parallel to the turret axis and a primary lens spaced therefrom;

detent means for establishing a final operating position of a mounted disc rotated and shifted into place between said light source and lens; and drive means for rotating a selected hub having a disc positioned in said optical system;

each hub having a drive shaft extending beyond the confines of said turret and having a drive receiving drum mounted thereon; and said drive means including a drive motor positioned stationarily at a location adjacent the position of said hub drive shaft of said selected hub, and said motor having a complementary drum means for engaging said hub shaft drum to impart drive rotation only to the selected hub and disc.

6. The device of claim 5, wherein said hub shaft drum and said motor drum both means are frictional elastomeric drums which engage and drive the hub and disc.

7. A turret font disc holder for a photocomposition machine, comprising:

a turret;

an axle, and means to journal said axle for rotation and for longitudinal shift movement;

said turret mounted on one end of said axle for rotation and shifting movements therewith;

a plurality of font disc mount hubs carried by said turret;

a stepper motor mounted on the other end of said axle and longitudinally shiftable therewith, and means for preventing motor body rotation as drive is imparted to said axle; and said turret having a cam track encircling said axis, a fixedly mounted cam follower positioned in contact with said track, and yieldable means urging the assembly of turret, axle and motor in a first direction against said cam follower, the cam track serving to shift the assembly against the yieldable means to position disc members mounted on said turret in a cam-selected plane.

8. A turret according to claim 7, wherein each hub presents a disc at an axially spaced position differing from all others for enabling the discs to be overlapped and the turret small, and said cam track configured such that each presented disc is shifted into one predetermined optical system plane as the disc is selected by rotation of the turret to select its hub.

* * * * *